United States Patent [19]

Fletcher et al.

[11] 4,047,473

[45] Sept. 13, 1977

[54] ASSEMBLY SYSTEM FOR CONTAINER FLEXIBLE END CLOSURES

[75] Inventors: Wade D. Fletcher; E. Riley Rowe, both of Hartsville, S.C.

[73] Assignee: Sonoco Products Company, Hartsville, S.C.

[21] Appl. No.: 586,011

[22] Filed: June 11, 1975

[51] Int. Cl.[2] ..... B31B 1/90

[52] U.S. Cl. ..... 93/36 B; 93/44.1 R

[58] Field of Search ..... 93/36 B, 39.1 R, 39.2, 93/55.1 R, 55.1 M, 44.1 R; 113/1 F, 80 R, 80 C, 80 D, 80 DA, 114 BF, 121 A, 121 C, 121 R

[56] References Cited

U.S. PATENT DOCUMENTS

| | | | |
|---|---|---|---|
| 1,258,493 | 3/1918 | Stark et al. | 113/80 C |
| 2,282,959 | 5/1942 | Gibbs | 113/80 D X |
| 2,441,876 | 5/1948 | Fleisch | 113/80 C |
| 3,352,268 | 11/1967 | Koll | 113/121 A |
| 3,460,314 | 8/1969 | Keas | 93/39.1 R X |
| 3,641,959 | 2/1972 | Hurst | 113/121 C X |
| 3,734,044 | 5/1973 | Asmus et al. | 113/121 C |
| 3,961,566 | 6/1976 | Westphal et al. | 93/36 B |

*Primary Examiner*—James F. Coan

*Attorney, Agent, or Firm*—Dennison, Dennison, Meserole & Pollack

[57] ABSTRACT

A system for assembling flexible end closures for containers, the closure itself including a peelable sealing membrane, with a folded pull tab, and a plastic overcap separably combined as a single unit for application to the container. Apparatus cuts the individual sealing membranes from a continuous web for deposit thereof on individual holders which vacuum retain the membranes during movement through stations which fold an integra pull tab in overlying relation to each membrane for subsequent reception within an associated overcap applied to the holder along the path of movement thereof, the combined membrane and overcap ultimately being discharged for later application to a container as a closure therefor. A central manifold controls air flow to and away from the individual holders so as to selectively retain and discharge the closure forming membrane and overcap components.

15 Claims, 19 Drawing Figures

FIG. 15
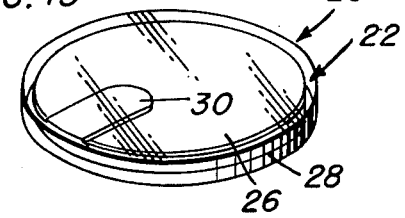
FIG. 17
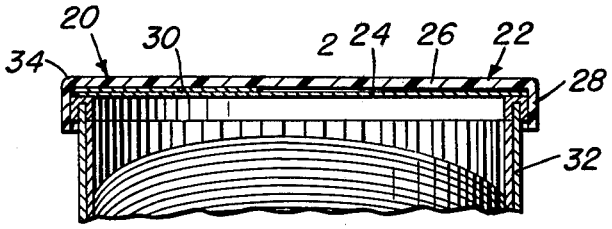
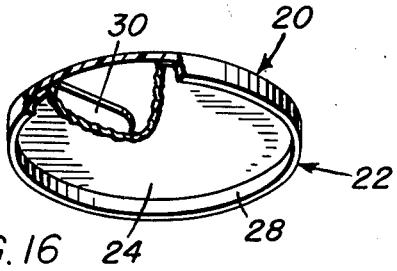
FIG. 16
FIG. 18
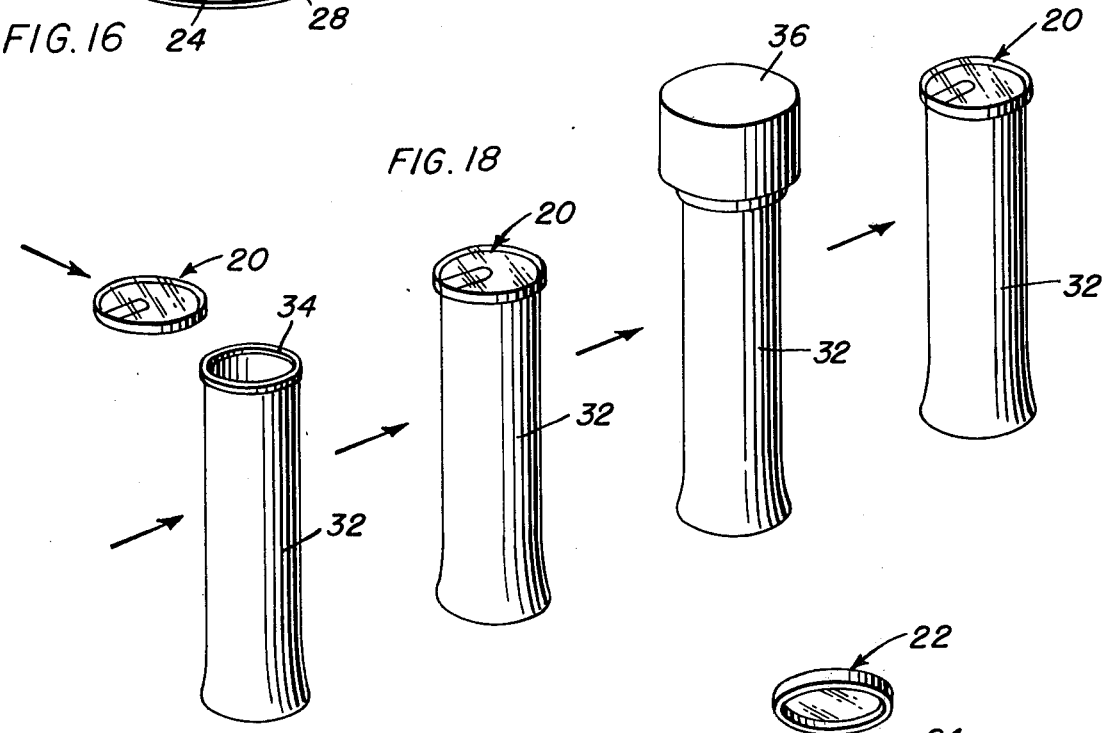
FIG. 19
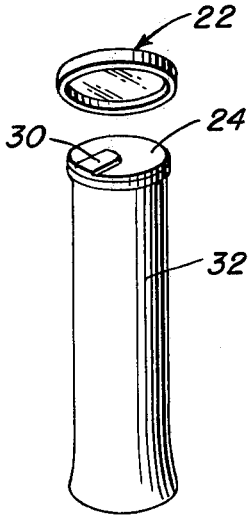

ASSEMBLY SYSTEM FOR CONTAINER FLEXIBLE END CLOSURES

The present invention is concerned with the provision of an end closure on a container, normally an elongated tubular fiber container used as a food package. More particularly, the invention herein is concerned with the construction of the end closure, the manner of forming the end closure, the manner of applying the end closure and the assembly apparatus utilized in the formation of the end closure.

It is a primary object of the invention to provide an end closure which can be economically produced and assembled to the container while at the same time providing the necessary positive air-tight seal and, for use after an initial opening of the container, a removable overcap for a selective resealing of the container as desired.

In conjunction with the above object, it is also a highly significant object of the present invention to provide assembly apparatus for forming the combined sealing membrange and overcap unit including the actual die cutting of each sealing membrane, the folding of the associated pull tab, and the positioning of the overcap in a manner so as to completely receive the sealing membrane therein. The formation of the end closure in this particular manner as a combined unit enables a one step application of both the sealing membrane and the overcap to the container.

Basically, the assembly apparatus includes multiple holders on a traveling table or platform which are sequentially aligned with a die cutter operable so as to die cut sealing membranes from a web of foil-like material having an appropriate adhesive layer thereon. Each membrane is retained on its individual holder through a manifold controlled vacuum as the membrane is carried through a series of stations which fold the integrally cut pulling tab into overlying relation with the membrane and mount a plastic cap thereover. Subsequent to a mounting of the overcap, the combined overcap and sealing membrane are discharged as a unit from the holder, assisted by manifold controlled air pressure, for collection externally of the machine and subsequent assembly on a container.

These together with additional features, objects and advantages will become apparent from the following wherein the details of construction and operation are more fully described and claimed. Reference is had to the accompanying drawings forming a part hereof wherein like numerals refer to like parts throughout, and in which:

FIG. 15 is a top perspective view of the combined sealing membrane and overcap unit;

FIG. 16 is a bottom perspective view, with a portion broken away for purposes of illustration, of the combined unit;

FIG. 17 is an enlarged cross-sectional detail through the container mounted end closure;

Figure 1:
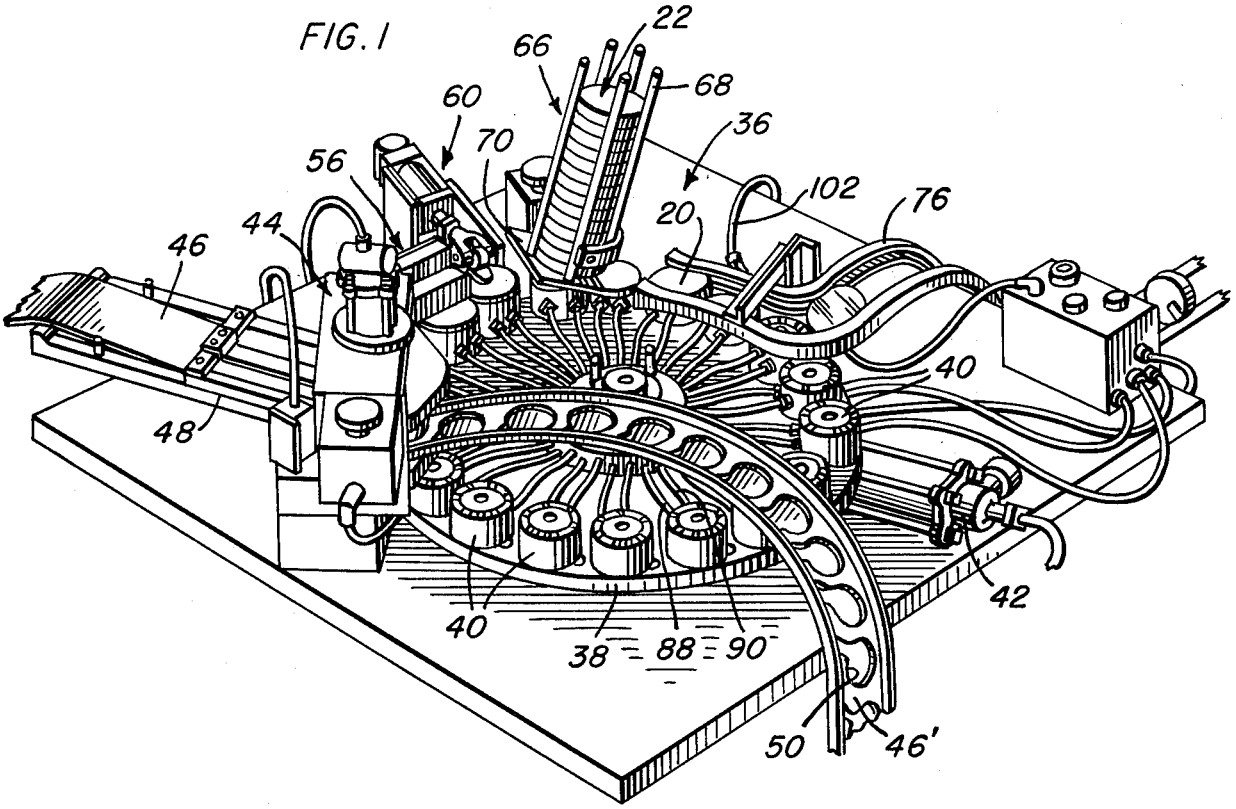
FIG. 1 is a perspective view of the closure forming and assembling apparatus.

FIG. 18 sequentially illustrates the steps involved in the mounting of the combined closure on the container end; and FIG. 19 illustrates the sealed container end with the overcap removed therefrom.

Referring now more specifically to the drawings, attention is initially directed to FIGS. 15, 16 and 17 wherein the closure unit, herein designated by reference numeral 20, is illustrated.

The closure unit 20 consists of two separable components, the overcap 22 and the sealing membrane 24 positioned against the undersurface of the top panel 26 and within the depending peripheral flange 28 of the overcap 22 for frictional retention thereby. The sealing membrane 24 includes a pull tab 30 integrally formed therewith and positioned so as to directly overlie the main panel of the membrane 24 adjacent the undersurface of the top panel 26 of the overcap 22 in the assembled closure unit 20.

As illustrated in the sectional detail of FIG. 17, the sealing membrane 24 is of a size so as to completely overlie the open end of the associated container 32 and peripherally engage the outer edge 34 for a sealing attachment thereto. It is contemplated that the sealing membrane be formed of a relatively heavy flexible foil having a high frequency responsive adhesive coating or layer on the undersurface thereof for a sealing to the peripheral container edge 34 through the utilization of a high frequency generator generally indicated by reference numeral 36 in the closure mounting sequence illustrated in FIG. 18. The overcap 22 is of a size so as to be snuggly receivable over the container end with the depending peripheral flange 28 gripping the container and enabling a removal and replacement of the overcap as desired. As will be appreciated, the packed container will be initially opened by a peeling away of the sealing membrane 24 with the container subsequently being opened and resealed by use of the overcap 22.

With more particular reference to FIG. 18, the sequence of steps in mounting the closure 20 to a container end 34 has been schematically illustrated. Basically, the combined overcap 22 and sealing membrane 24 are applied as a unit 20 to the open end of the container 32 and the adhesive engaged with the container rim activated by the high frequency generator 36 for peripherally sealing the adhesive coated undersurface of the sealing membrane 24 to the container rim 34. This sealing of the membrane 24 to the container end is effected independently of the overcap 22 whereby, as shown in FIG. 19, the overcap 22 is freely removable from the sealed end to expose the sealing membrane 24 for a removal of this membrane 24 by the ultimate purchaser of the packaged product. Once the membrane is stripped from the container, the container can be resealed in an obvious manner by use of the overcap 22. Incidentally, the container 32, as shown in FIGS. 18 and 19, will have the second end thereof closed in a conventional manner at the desired point in the product packaging procedure subsequent to introduction of the product.

As will be appreciated, the complete closure, including the sealing membrane and the overcap, is mounted on the container and selectively sealed thereto as a single unit, notwithstanding the fact that the overcap is in fact separable from the sealing membrane for use in the manner of a conventional overcap.

Figure 2:
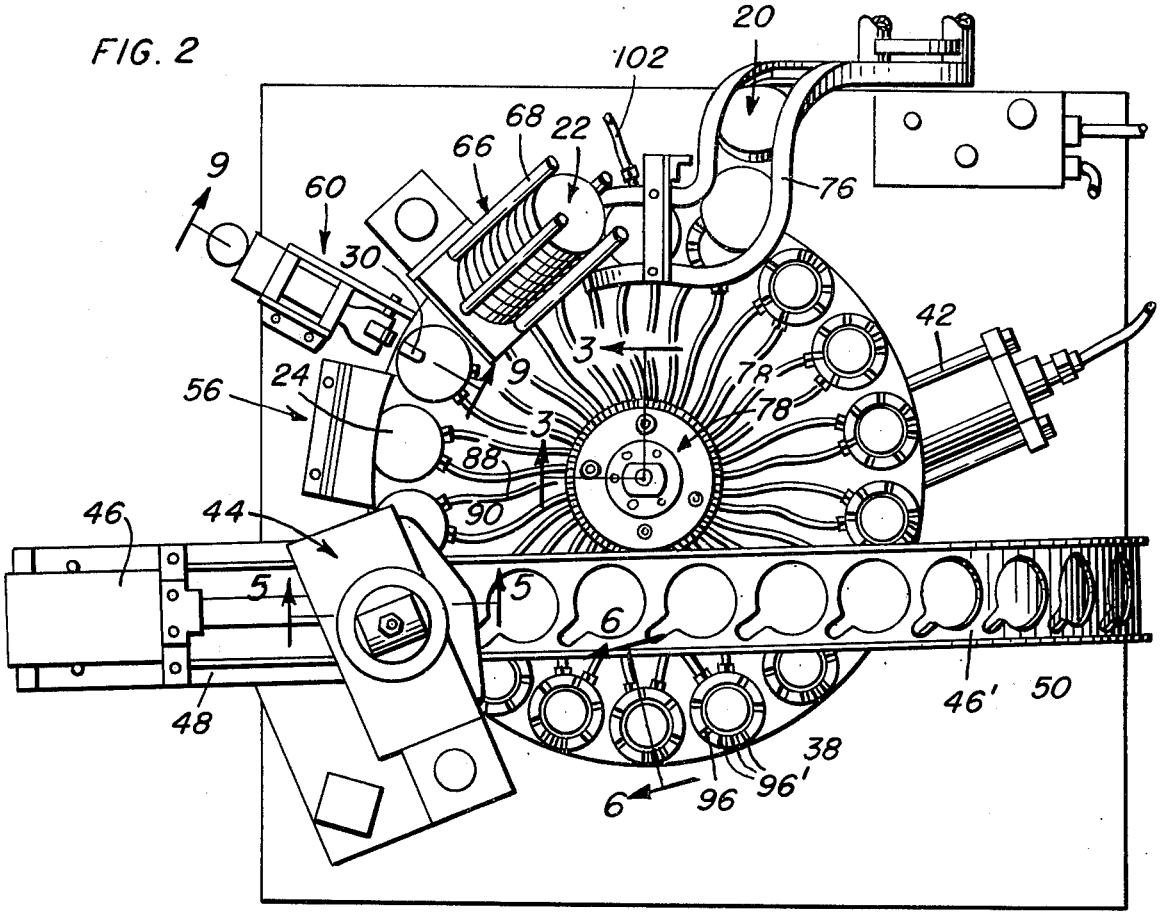
FIG. 2 is a top plan view of the apparatus.

Referring now to the assembling of the combined sealing membrane and overcap unit, attention is directed initially to FIGS. 1 and 2 wherein the overall assembling apparatus is illustrated. This apparatus, generally designated by reference numeral 35, includes a support table or platform 38 upon which a series of individual cylindrical holders 40 are mounted for indexing through a series of stations in response to movement of the table 38. The means for effecting the indexing or holder carrying movement of the table 38 has been generally indicated by reference numeral 42 and can in fact be of any conventional construction.

The holders 40 each, upon a clockwise rotation of the table 38, initially move into a die cutting or punching station 44 within which the individual sealing membranes 24 are cut from an elongated strip or web 46 of foil-like material coated on one face thereof. The web of material 46, extending from a suitable supply roll or the like, not shown, is fed through an appropriate guide assembly 48 into the station 44 with the remnant of the web 46, designated as 46', discharging from the station 44 along an elongated guide channel 50.

Figure 5:
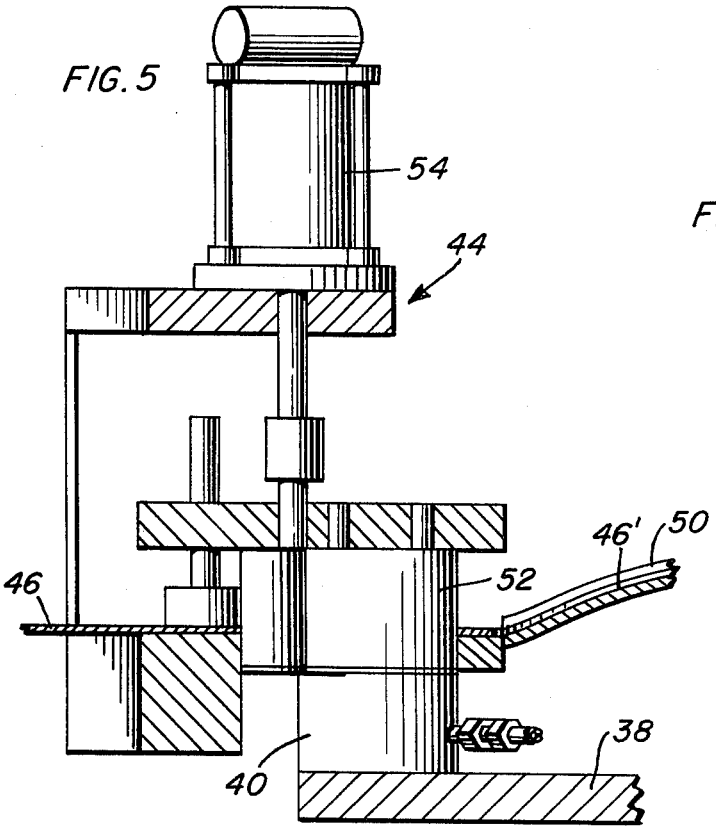
FIG. 5 is a cross-sectional detail through the membrane cutting unit taken substantially on a plane passing along line 5—5 in FIG. 2.

Within the station 44, noting FIG. 5, a reciprocating die or punch 52 moves downwardly, severing a circular membrane forming member, with a coplanar projecting tab, from the web 46 and positions this membrane forming member directly on one of the aligned holders 40 positioned immediately therebelow. Actuation of the cutter or punch 52 can be affected by any appropriate means such as the powered reciprocating ram unit 54 suggested in the drawings. Actuation of the punch will of course by synchronized with the movement of the table 38 so as to at all times provide a holder 40 in subjacent alignment with the sealing membrane being severed from the web 46.

Figure 7:
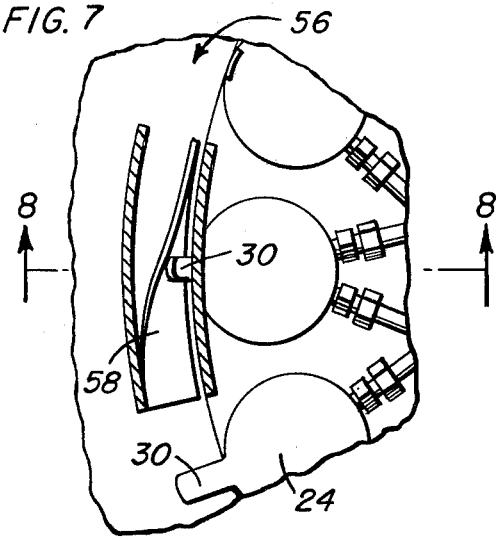
FIG. 7 is a detailed illustration of the initial tab folding station.
Figure 8:
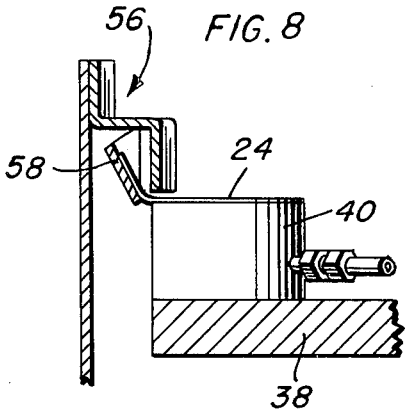
FIG. 8 is a sectional view taken substantially on a plane passing along line 8—8 in FIG. 7.

With reference to FIGS. 7 and 8, in conjunction with FIGS. 1 and 2, the next station 56 approached by the individual holder 40, now having the cut membrane forming member thereon, includes a plate 58 gradually curving from an initial horizontal end portion to a final vertical end portion. The plate 58 is orientated in the path of movement of the projecting tab and effects a gradual bending of the tab from the plane of the horizontal membrane to a position projecting vertically upward therefrom.

Figure 9:
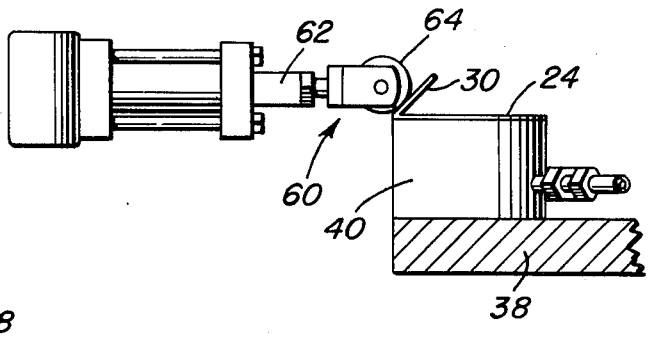
FIG. 9 is a detailed view of the final tab forming station taken substantially on a plane passing along line 9—9 in FIG. 2.

The next station 60, detailed in FIG. 9, includes a reciprocating power ram assembly 62. This assembly mounts a roller 64 on the outer end of the reciprocating ram with the roller engaging the vertical tab 30 and pressing this tab flat against the upper surface of the main panel of the membrane 24. Operation of the ram assembly 62 will of course also be synchronized with the rotation of the holder carrying table 38.

Figure 10:
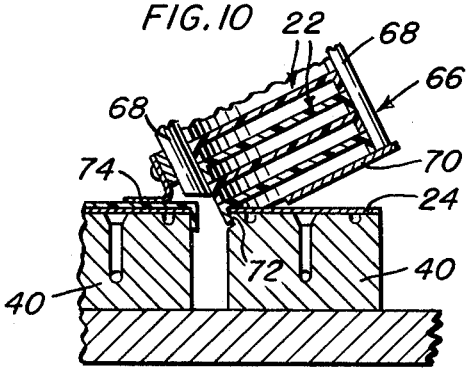
FIG. 10 is a detailed view illustrating the mounting of the overcap.
Figure 11:
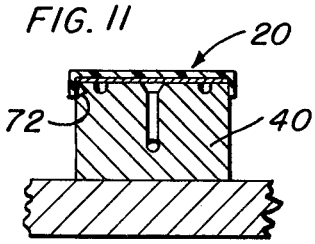
FIG. 11 is a view of the combined membrane and overcap mounted on a holder.
Figure 12:
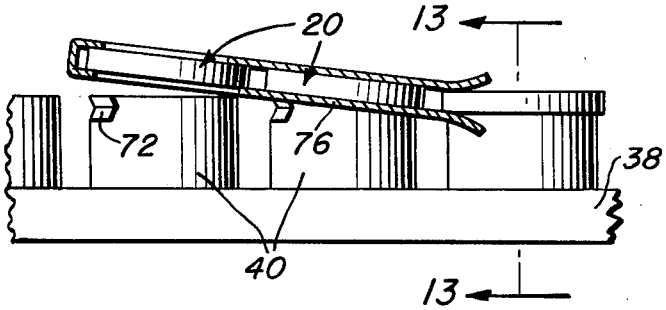
FIG. 12 is an elevational view illustrating the holders at the point of discharge of the combined closure from the holders.
Figure 13:
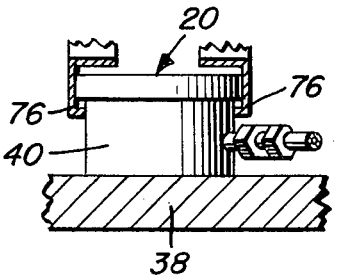
FIG. 13 is a sectional view taken substantially on a plane passing along line 13—13 in FIG. 12.

Subsequent to a down-folding of the tab 30, the selected holder 40 moves to and through the overcap loading station 66. This station 66 retains a stack of overcaps 22 inclined slightly along the direction of movement of the holders 40. The caps 22 are retained within an elongated chute defined by a plurality of peripherally spaced rods 68 with the overcaps 22 supported at the lower end of the chute by a partial bottom plate 70 orientated so as to expose the far end of the lowermost overcap 22 in the path of movement of each approaching holder 40. This particular relationship will be best appreciated from FIG. 10 wherein it will be noted that the leading face of each holder 40 includes a slight undercut 72 immediately below the upper edge thereof so as to provide in effect a gripping lip receivable within the flanged lowermost portion of the bottom overcap 22 in order to effect an outward pulling of the overcap 22 for engagement over the upper end of the membrane supporting holder 40. As the overcap 22 is drawn from the bottom of the stack by the holder 40 moving therepast, any appropriate means, such as brackets 74, can be provided so as to firmly press the overcap over the upper end of the holder 40 and seat the overcap directly on the holder supported membrane 24. At this point, as will be noted in FIG. 11, the two part closure unit 20 is completely assembled on the holder 40.

After the overcap 22 has been fully seated on the membrane supporting holder 40, therby snuggly positioning the membrane 24 within the overcap 22, the combined overcap and membrane are removed as a unit by a pair of opposed side rails 76 which are orientated in the path of movement of the holders 40 and engage beneath the opposed edges of the overcap flange 28, the rails inclining slightly upward so as to, as each holder 40 passes thereby, gradually elevate the combined closure unit 20 from the associated holder 40. These rails 76 continue laterally off to an appropriate discharge or closure stacking position.

The assembly apparatus also includes an air system, operable through a central manifold assembly 78 and the individual holders 40, which functions so as to stabilize the punch cut membrane 24 and overcap 22 on the individual holders through stations 44, 56, 60 and 66, and assist in effecting a discharge of the combined membrane and cap unit in conjunction with the action of the closure lifting rails 76.

The manifold assembly 78, centrally located on the rotating table 38, includes a lower annular distributor plate 80 pin locked, as at 82, to the table 38 for rotation therewith. Noting FIGS. 3 and 4 in particular, the distributor plate is provided with a first series of right angular vacuum passages 84 extending vertically through the upper surface thereof and horizontally through the peripheral edge, and a second series of right angular air pressure passages 86 likewise including a branch extending vertically through the top of the plate 80 and a second branch extending horizontally through the peripheral edge of the plate 80. The vacuum passages 84 have the upper intake ends thereof, openings through the top of the distributor plate 80, circumferentially aligned about the plate 80 with the intake ends of the pressure passages 86 being radially offset from the vacuum passages and also circumferentially aligned about the plate 80.

Figure 6:
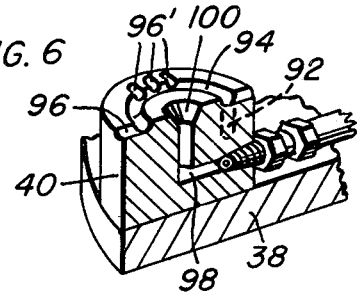
FIG. 6 is an enlarged cross-sectional detail taken substantially on a plane passing along line 6—6 in FIG. 2 and illustrating a typical holder.

Each of the holders 40, noting particularly FIGS. 1 and 6, is communicated with both one vacuum passage 84 and one pressure passage 86 respectively by means of elongated air lines 88 and 90. With regard to each individual holder 40, the vacuum line 88 communicates with an interior vacuum passage 92 within the holder 40 which opens upwardly into a circular channel 94 defined in the upper surface of the holder 40 with this channel 94 including communicating radially outwardly directed upwardly opening grooves 96 at equally spaced points thereabout. At a point about the upper surface of the holder 40 which corresponds to the orientation of the membrane tab 30, a series of three closely spaced channel communicating radially extending grooves 96' will be provided rather than the single grooves 96 as elsewhere formed about the holder upper surface. This is considered particularly significant so as to avoid any possible leakage resulting from a slight raising or bending of the membrane at the point at which the tab is folded.

The pressure line 90 associated with each holder 40 is engaged in pressure transferring communication with an internal air passage 98 which in turn opens centrally upward through a discharge port 100 in the upper surface of the associated holder 40.

Basically, a vacuum will be drawn through the individual holders 40 commencing with the entry of the holder into the membrane punching station 44 so as to receive the cut membrane and effect a clamping thereof to the upper surface of the holder. As previously indicated, the multiple vacuum grooves 96' are orientated so as to be directly overlaid by that portion of the membrane 24 from which the tab 30 projects. The vacuum effect retains the membrane firmly clamped to the top of the holder 40 as the holder travels to and through the folding stations 56 and 60 wherein the multiple grooves 96' continue to maintain an effective grip on the membrane notwithstanding a possible slight raising of the membrane edge at the location of the fold. The vacuum grip is continued through the overcap loading station 66 and slightly therebeyond so as to insure a proper feeding of the overcap 22 completely on the holder 40 in a manner so as to releasably fix the membrane 24 therein. The vacuum through the individual holder 40 is then terminated and the continued movement of the holder 40 brings the now completed closure 20 into alignment with the lifting rails 76 for a removal of the closure 20 from its associated holder 40. At this time, positive air pressure is introduced through the associated air passage 86, hose 90, holder passage 98 and central discharge port 100 so as to effect a pressurized upward lifting of the completed closure in conjunction with the lifting action and guiding action of the rails 76. As will be appreciated, each of the rails 76 includes an overlying flange which tends to retain the closure 20 as the closure 20 is being removed from the holder. The discharging air pressure also of course functioning so as to insure a complete seating of the membrane 24 within the overcap 22 during the removal of the combined closure unit.

As will be noted from FIGS. 1 and 2, the rails 76 will normally direct the closures 20 outwardly away from the table for storage. In order to assist in this outward movement of the closures 20, an air line 102 can be so orientated, relative to the rails 76, as to produce a flow of air in the desired direction of movement of the now loose closures 20 to facilitate their movement along the guide rails 76 to the storage location.

In order to effect the selective application of vacuum and pressure to the individual holders 40, a fixed position valve plate 104 is utilized. This valve plate 104, noting FIGS. 3, 4 and 14 in particular, includes, communicating through the undersurface thereof, an elongated arcuate chamber 106 which overlies the upwardly directed intake ends of the vacuum passages 84. As previously noted, the valve plate 104 is fixed relative to the rotating table 38 and rotating distributor plate 80 with the orientation of this chamber 106 corresponding to the location of stations 44, 56, 60 and 66, that portion of the rotational travel of the holders during which a vacuum is to be applied. A vacuum line 108 communicates with the chamber 106 through the top of the valve plate 104, this line extending from an appropriate source of negative pressure such as a vacuum pump or the like. With this arrangement, it will be appreciated that as each individual holder approaches the cutting or punching station 44, communication of the associated vacuum line 88 with the vacuum source is effected through alignment with the first end of the valve plate vacuum chamber 106. This vacuum introducing communication continues throughout the extent of the arcuate length of the vacuum chamber 106 which corresponds to the movement of the holder through the final overcap loading station 66.

Once the individual station 40 moves beyond the station 66, the rotation of the table 38 and distributor plate 86 thereto moves the associated distributor plate vacuum passage 84 out of communication with the chamber 106. Continued movement of the holder, table and distributor plate will, as the holder enters between the lifting and guiding rails 76, communicate the associated distributor plate positive air pressure passage 86 with a second arcuate and substantially shorter air pressure chamber 110. Upon communication with the air pressure chamber 110, pressurized air is introduced through the pressure passage 98 in the holder 40 and discharges forcibly through the discharge port 100 so as to assist in raising the combined membrane and overcap closure 20 from the holder 40. Pressurized air is supplied to the chamber 110 by means of an appropriate air hose 112 which in turn extends from an appropriate source. Once rotation of the table 38 has carried the particular holder 40 beyond the point at which the closures 20 are discharged, the holder, and more particularly the associated air flow passages from and through the distributor plate 80 are moved out of communication with the pressure chamber 110.

Figure 14:
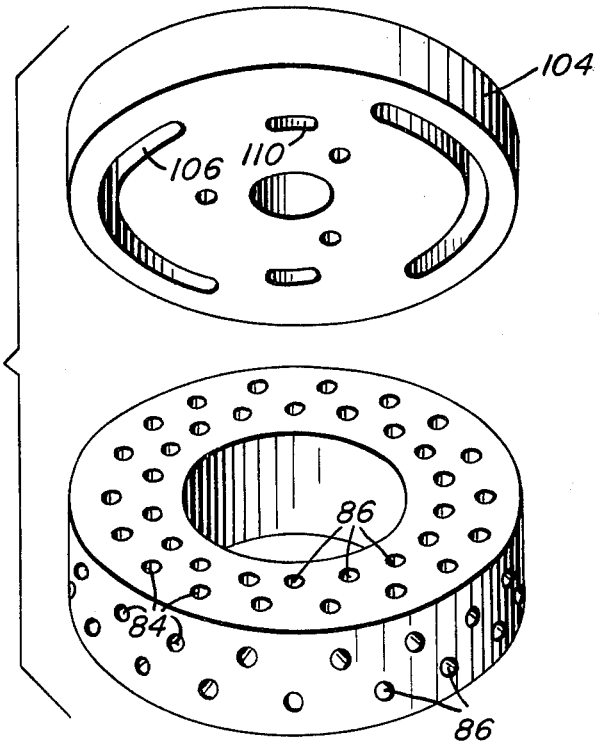
FIG. 14 is an exploded perspective view of the distributor plate and valve plate of the manifold assembly.
Figure 4:
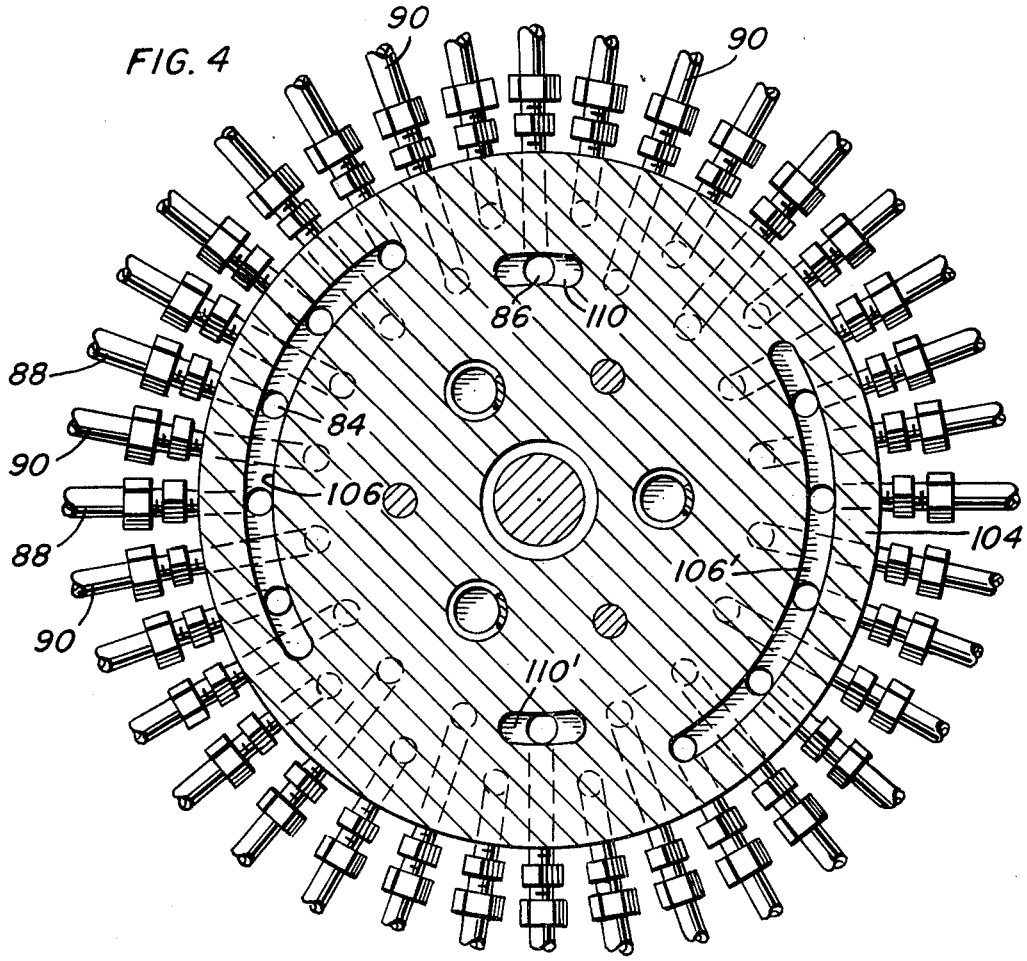
FIG. 4 is a cross-sectional detail taken substantially on a plane passing along line 4—4 in FIG. 3.

Noting FIGS. 4 and 14, it will be seen that the valve plate 104 actually includes a second elongated vacuum chamber 106' and a second relatively shorter pressure chamber 110' diametrically opposed the respective chambers 106 and 110. This second set of chambers is provided in that it is contemplated that the assembly machine can be expanded so as to in effect double capacity by having a second series of closure forming and assembling stations associated therewith about the travel path beyond the illustrated closure discharging rails 76 and the punching station 44.

Figure 3:
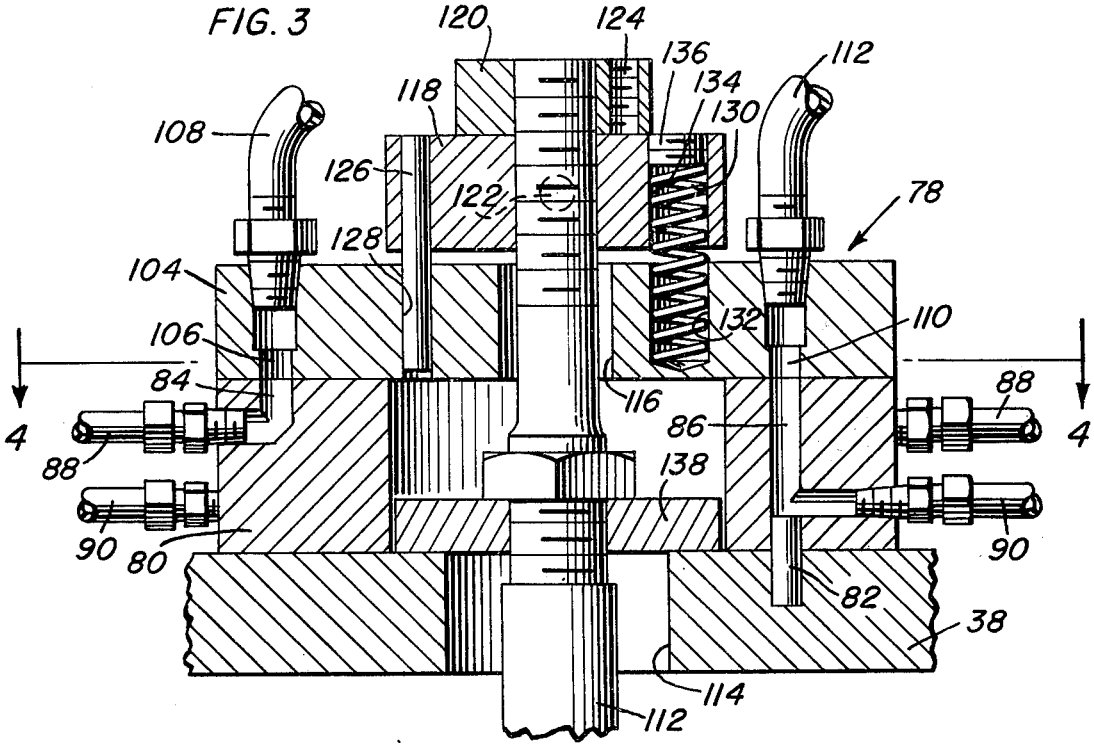
FIG. 3 is an enlarged cross-sectional detail through the vacuum and pressure distributing manifold assembly taken substantially on a plane passing along line 3—3 in FIG. 2.

Turning now to FIG. 3, an elongated central stud 112, extending through a central opening 114 in the rotating table 38, projects vertically through the annular distributor plate 80, through a central opening 116 in the valve plate 104 and upwardly therebeyond for the threaded reception of a holder 118 and a top nut 120.

The holder 118, in addition to being threaded on the upper end of the stud 112, is locked thereto by appropriate set screw means 122. The nut 120 in turn is locked in position by set screw 124. The holder 118 fixes the position of the valve plate 104 by means of three vertical pins 126 locked therein and depending into bores 128 provided in the valve plate 104 immediately therebelow. Constant pressure is applied downward on the valve plate, so as to maintain an appropriate seal with the underlying rotating distributor plate 80, by means of three expanded coiled compression springs 130 engaged within upwardly opening blind bores 132 in the valve plate 104 and downwardly opening bores 134 in the holder 118. The holder bores 134 have the upper ends thereof closed by threaded plugs 136 which allow for a replacement of the springs 130 and in fact some degree of adjustment thereof. An appropriate stabilizing plate 138 can be orientated within the open core of the distributor plate 80. The plate 138 in no way affects the rotation of the table 38 relative to the fixed position shaft 112.

From the foregoing, it will be recognized that the assembly system set forth constitutes a unique manner of forming a combined closure unit which incorporates not only the sealing membrane which is adhesively bonded to the container end, but also a separable overcap utilized by the ultimate consumer in selectively opening and closing the container as access to the contents is desired. The apparatus itself is, while highly unique, relatively straightforward in both structure and manner of operation. The ultimate product, that is the combined sealing membrane and overcap, is itself a unique departure from prior art caps and capping systems wherein the independent application of the end cap or sealing membrane is followed by the independent mounting of the overcap, requiring in effect multiple assembly steps as opposed to the single mounting step resulting from the distinctive closure assembly proposed herein.

The foregoing is considered basically illustrative of the principles of the invention. It is to be appreciated that since numerous modifications and changes may readily occur to those skilled in the art, it is not desired to limit the invention to the exact construction and operation shown and described. Accordingly, all suitable modifications and equivalents may be resorted to, falling within the scope of the invention as claimed.

We claim:

1. A method of forming a closure for mounting as a unit over the open end of a container, said method comprising the steps of forming a sealing membrane and releasably engaging an overcap over the membrane in a manner so as to releasably secure the membrane within the confines of the overcap, the forming of the sealing membrane including the steps of forming an integral outwardly projecting tab on said membrane and folding said tab laterally of the plane of said membrane.

2. Assembly apparatus for a container closure comprising multiple holders, means mounting said holders for carrying said holders through a plurality of assembly stations, said assembly stations including a first station incorporating means for forming a disc-like sealing membrane, with a laterally projecting integral tab on said membrane, and depositing the formed membrane on one of said holders, a second station, immediately downstream of the first station along the path of travel of the holders, including means for engaging and folding said tab in overlying relation to the membrane, a subsequent station along the path of travel of the holders including means for mounting an overcap over the membrane accommodating holder in a manner so as to seat on the holder with the membrane received within the overcap, and a final discharge station, along the path of travel of the holders, including means for effecting a discharge of the combined membrane and overcap from the associated holder.

3. The assembly apparatus of claim 2 including vacuum means operating through said holders at each of said stations other than said discharge station for retention of each membrane on the associated holder.

4. The assembly apparatus of claim 3 including positive pressure means for operation through said holders at said discharge station for effecting a pressure assisted discharge of the combined membranes and overcaps.

5. The assembly apparatus of claim 4 including a manifold assembly regulating said vacuum means and said positive pressure means for selective operation thereof in response to orientation of the individual holders relative to the selected stations.

6. The assembly apparatus of claim 5 wherein said manifold assembly comprises a distributor plate incorporating a vacuum passage and a positive pressure passage for each holder, pressure lines extending from each passage to the associated holder, said distribution plate moving with said holders, and a valve plate associated with said distributor plate in a manner so as to close the ends of the distributor plate passages remote from the lines, said valve plate being fixed relative to the movable distributor plate and including an elongated vacuum chamber orientated relative to the vacuum passages so as to communicate with these passages as the holders associated with the passages travel through each station other than the discharge station, and a positive pressure chamber in said valve plate orientated so as to communicate with the positive pressure passages in the distributor plate as the corresponding holders move through the discharge station.

7. The assembly apparatus of claim 6 wherein each holder includes a positive pressure passage therethrough communicated with the associated pressure line and opening upwardly generally centrally through said holder for an upward discharge of positive pressure, and a vacuum passage communicated with the associated vacuum line and opening upward through a peripheral groove defined in the upper surface of the holder for the development of a vacuum effect peripherally about the holder.

8. The assembly apparatus of claim 7 including radially extending upwardly opening grooves communicating with the peripheral groove for increasing the area of vacuum induced attraction with the overlying membrane.

9. The assembly apparatus of claim 8 wherein a plurality of said radially extending grooves are orientated juxtaposed each other at a point corresponding to the proposed orientation of the membrane tab whereby any deformation of the membrane during the tab folding will not affect the vacuum retention of the membrane.

10. Assembly apparatus for a container closure comprising multiple holders, means mounting said holders for carrying said holders through a plurality of assembly stations, said assembly stations including a first station incorporating means for forming a substantially planar sealing membrane, with a laterally projecting integral tab on said membrane, and depositing the formed membrane on one of said holders, a second station, downstream of the first station along the path of travel of the holders, including means for engaging and folding said tab relative to the membrane to a position displaced from the plane of the membrane, a subsequent station along the path of travel of the holders including means for mounting an overcap over the membrane accommodating holder in a manner so as to seat on the holder with the membrane received within the overcap, and a final discharge station, along the path of travel of the holders, including means for effecting a discharge of the combined membrane and overcap from the associated holder.

11. Assembly apparatus for a container closure comprising at least one holder, means mounting said holder for carrying said holder through a plurality of assembly stations, said assembly stations including means for supplying a substantially planar sealing membrane with a laterally projecting tab thereon, means for depositing the membrane on said holder, means for engaging the tab of the holder mounted membrane and for folding the tab relative to the membrane to a position displaced from the plane of the membrane, means for mounting an overcap over the holder and membrane mounted thereon to seat the overcap on the holder with the membrane received within the overcap, and means for effecting a discharge of the combined membrane and overcap from the associated holder.

12. The assembly apparatus of claim 11 wherein the means for folding the tab folds the tab to project at least at substantially right angles to the plane of the membrane.

13. A method of forming a closure for mounting as a unit over the open end of a container, said method comprising the steps of forming a sealing membrane and releasably engaging an overcap over the membrane in a manner so as to releasably secure the membrane within the confines of the overcap, the forming of the sealing membrane including the steps of forming an integral outwardly projecting tab on said membrane and progressively folding said tab into overlying relation with said membrane.

14. The method of claim 13 including the step of depositing the membrane on a travelling holder prior to folding said tab, said overcap engaging over the membrane on said holder for travel therewith.

15. The method of claim 14 including the step of discharging the engaged membrane and overcap as a unit from the holder.

* * * * *